US005961316A

United States Patent [19]

Wellman et al.

[11] Patent Number: 5,961,316

[45] Date of Patent: Oct. 5, 1999

[54] OIL BURNER

[75] Inventors: James E. Wellman, South Bend; Edward W. Johann; Eric Warry, both of Michigan City; Donald C. Metrish, LaPorte, all of Ind.

[73] Assignee: Weil-McLain, Michigan City, Ind.

[21] Appl. No.: 08/547,973

[22] Filed: Oct. 25, 1995

[51] Int. Cl.[6] ..... F23D 11/00

[52] U.S. Cl. ..... 431/159; 431/154; 431/189; 431/202; 431/265; 431/356

[58] Field of Search ..... 431/154, 159, 431/189, 202, 356, 160, 260, 265

[56] References Cited

U.S. PATENT DOCUMENTS

| | | | |
|---|---|---|---|
| 450,052 | 4/1891 | Bliss et al. | 431/189 |
| 1,086,715 | 2/1914 | Irish . | |
| 1,126,654 | 1/1915 | Peabody . | |
| 1,291,589 | 1/1919 | Maxon . | |
| 1,935,237 | 11/1933 | Bryant . | |
| 2,300,903 | 11/1942 | Beckett . | |
| 2,390,509 | 12/1945 | Carter . | |
| 2,500,787 | 3/1950 | Lelgemann . | |
| 2,777,509 | 1/1957 | Beckett . | |
| 2,831,535 | 4/1958 | Lange . | |
| 2,840,152 | 6/1958 | Reed . | |
| 2,960,275 | 11/1960 | Wolf . | |
| 3,349,826 | 10/1967 | Poole et al. . | |
| 3,556,700 | 1/1971 | Jackson et al. . | |
| 3,586,242 | 6/1971 | Woolard et al. . | |
| 3,796,209 | 3/1974 | Luft . | |
| 3,905,752 | 9/1975 | Miller . | |
| 4,003,693 | 1/1977 | Straitz, III . | |
| 4,054,028 | 10/1977 | Kawaguchi . | |
| 4,082,495 | 4/1978 | Lefebvre . | |
| 4,106,890 | 8/1978 | Fulmer et al. . | |
| 4,197,076 | 4/1980 | Viger . | |
| 4,383,820 | 5/1983 | Camacho . | |
| 4,388,064 | 6/1983 | Kaplan et al. . | |

(List continued on next page.)

FOREIGN PATENT DOCUMENTS

| | | | |
|---|---|---|---|
| 2648896 | 12/1990 | France | 431/154 |

OTHER PUBLICATIONS

Adams INTERburner Brochure, Form No. IB–86.

The AERO–dynamic Design Brochure, Sep., 1992.

AERO The Keeper of the Flame! Brochure, Sep., 1992.

AERO The Name for Quality, Efficiency and Economy above all! Brochure, 1992.

Weil–McLain Instruction Manual for Model AFG Oil Burner Brochure, Jul., 1990.

What's New From Beckett Brochure, Jul., 1994.

Weil–McLain Burner Manual for Carlin Model 99FRD High Efficiency Oil Burner, Jun., 1988.

Weil–McLain Burner Manual for CCT Elite Models, Apr., 1993.

Riello 35 Oil Burner Installation Manual for Retrofit Applications, May, 1993.

Riello Technical Sheet—Power Gas Burners GAS 3/2 –4/2 –5/2 –6/2 –7/2, Oct., 1991.

Weil–McLain Wayne Blue Angel Model HS High Efficiency Oil Burner Manual, Sep., 1993.

*Primary Examiner*—Larry Jones

*Attorney, Agent, or Firm*—Barnes & Thornburg

[57] ABSTRACT

An oil burner includes a pivotal cover that exposes a unitary gun assembly. The gun assembly is movable longitudinally with respect to the central axis of the air tube of the burner by rotating a cam. A spinner assembly is positioned on the gun assembly. The air cone is divided into various surfaces, some of which are at angles to the axis of the air tube. The burner further includes an adjustable air entry port. A work station for facilitating nozzle replacement is also included. The firing rate is controlled by the air entry port setting, the nozzle used, and the position of the nozzle and spinner assembly in the air cone.

49 Claims, 4 Drawing Sheets

U.S. PATENT DOCUMENTS

| | | | |
|---|---|---|---|
| 4,443,182 | 4/1984 | Wojcieson et al. . | |
| 4,484,887 | 11/1984 | Pettersson . | |
| 4,493,271 | 1/1985 | Ohayon et al. . | |
| 4,595,355 | 6/1986 | Garrelfs et al. . | |
| 4,731,015 | 3/1988 | Johnson | 431/154 |
| 4,813,867 | 3/1989 | Yoshida et al. . | |
| 4,899,670 | 2/1990 | Hansel . | |
| 4,952,136 | 8/1990 | Collins, Jr. et al. . | |
| 5,055,032 | 10/1991 | Altemark et al. . | |
| 5,090,897 | 2/1992 | Christenson . | |
| 5,107,776 | 4/1992 | Garcia-Mallol . | |
| 5,172,545 | 12/1992 | Forestier . | |
| 5,184,949 | 2/1993 | O'Brien . | |
| 5,209,893 | 5/1993 | Askin et al. . | |
| 5,348,468 | 9/1994 | Graf et al. . | |
| 5,490,774 | 2/1996 | Mann et al. | 431/154 |
| 5,542,841 | 8/1996 | Nakashima et al. | 431/160 |
| 5,630,713 | 5/1997 | Shver et al. | 431/160 X |

OIL BURNER

BACKGROUND AND SUMMARY OF THE INVENTION

The present invention relates to heating products and, in particular, to oil burners.

Various types of oil burners are known in the prior art. Typically, oil is fed into the burner by a pump. Once inside the pump, the oil is atomized through a nozzle adjacent a burner head or spinner. The oil is ignited by a pair of electrodes. Air is brought into the housing by a blower wheel disposed therein rotated by a motor. The blower wheel forces the air through the burner head or spinner and out the front of the burner. The blower wheel moves air out of the burner at a sufficient rate to cause a flame to extend from the front of the burner. The combustion characteristics of the burner are controlled by several factors, including the pump pressure, the position of the spinner, the nozzle and the quantity of air flow.

It is an object of the present invention to provide an oil burner for residential and commercial heating.

Another object of the present invention is to provide an oil burner that allows for a wide range of adjustment of the firing rate.

Another object of the present invention is to provide an oil burner with a reduced level of noise during operation.

Another object of the present invention is to provide an efficient and dependable oil burner that is easy to maintain and service.

These and other objects of the present invention are attained by the provision of an oil burner having a housing, a gun assembly in the housing and a cam coupled to the gun assembly. Movement of the cam causes movement of the gun assembly. The cam includes a slot and a pin extending into the housing and is rotatably coupled to the gun assembly. The pin can be adjusted to lock the cam in place. The pin may include an enlarged portion to prevent vertical displacement of the pin from the slot. The slot may include an enlarged portion to allow the cam to be lifted over the enlarged portion of the pin.

According to another embodiment of the present invention, the gun assembly includes a body having an oil inlet, a passageway therethrough and a nozzle attachment portion. The body and nozzle attachment portion are integrally formed. The gun assembly may also include an integrally formed electrode mounting platform and an integrally formed flange for supporting the gun assembly in the oil burner. The oil burner may be provided with a work station generally conforming to the shape of a portion of the gun assembly for facilitating removal of the nozzle. The gun assembly may also include a surface for locating a spinner assembly on the gun.

According to another embodiment of the present invention, an oil burner includes a housing, first and second pins extending from the housing, a cover and a slot in the cover. The slot has a first end and a second end and is disposed about the first pin. An arm extends from the cover beneath the second pin. The slot, arm and pins are arranged such that the arm prevents the cover from pivoting when the first pin is at or near the first end of the slot, but allows the cover to pivot about when the first pin is at or near the second end of the slot. The cover may be provided with an additional slot and pin. The cover may be further provided with means for locking the cover in place.

According to yet another embodiment of the present invention, an oil burner includes an air cone having a first end, a second end and an axis extending from the first end to the second end. The air cone includes first and second surfaces angling inward toward the axis with distance from the first end. The angle between the axis and the second surface is less that the angle between the axis and the first surface. The air cone may include other surfaces, some of which may be cylindrical. Some of the surfaces may also include holes therethrough. Others may angle away from the central axis with distance from the first face. The oil burner may further include a gun assembly having a spinner movable between the various regions.

According to another embodiment of the present invention, an oil burner includes a housing and an air entry port. The inlet includes a projection extending from the housing and a gap formed in the projection. A cover having an extended portion extending toward the housing is disposed adjacent the projection and is moveable with respect thereto. In this manner, the extended portion can be positioned to cover a portion of the gap. Baffles extending from the cover may also be provided. The burner may further include a pin extending from the projection through an opening in the cover. The opening may be positioned such that it is disposed over a portion of the gap when the extended portion is disposed so as to cover a portion of the gap. The burner may also include means for locking the cover in place.

In another embodiment of the invention, an oil burner spinner includes a rim having a front face and a substantially flat rear face. A plurality of blades are attached to the rim. The rim may angle inward. Each blade has a first surface and a second surface. The first surface of each blade is disposed in substantially the same plane. The second surface of each blade is angled so as to extend behind the rear face of the rim. A constant gap may be maintained between blades. An opening may also be provided in the center of the spinner. The spinner may also include a leg assembly attached to the rim.

In yet another embodiment of the present invention, an oil burner includes a housing, a first flange integrally formed with the housing, an air tube and a second flange integrally formed with the air tube and mounted to the first flange. The first flange may include a recessed surface for receiving the second flange.

Other objects, advantages and novel features of the present invention will be apparent upon consideration of the following description of the preferred embodiments and accompanying drawings.

DETAILED DESCRIPTION OF THE PREFERRED EMBODIMENTS

Figure 1:
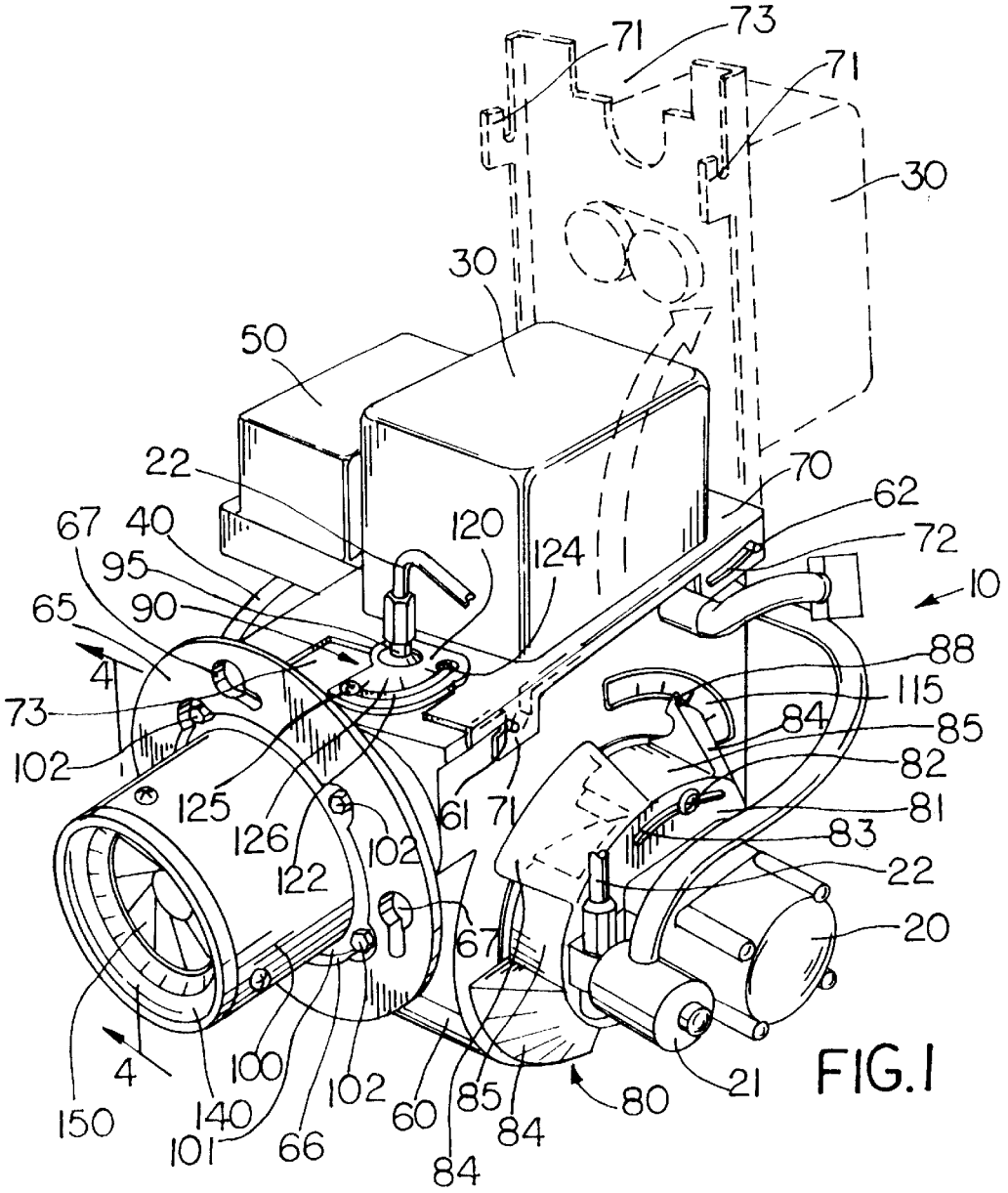
FIG. 1 is a perspective view of one embodiment of an oil burner according to the present invention.

FIG. 1 shows an embodiment of an oil burner 10 according to the present invention. Oil burner 10 generally comprises a fuel pump 20, ignition transformer 30, motor 40, controller 50, housing 60, cover 70, air entry port 80, gun assembly 90 and air tube 100.

Pump 20 includes a solenoid valve 21 and directs oil from a supply (not shown) through oil line 22 and into gun assembly 90, where the oil is ignited on exit by a pair of electrodes (not shown in FIG. 1). The electrodes are sparked by ignition transformer 30. In FIG. 1, the central portion of oil line 22 has been removed to allow a clearer view of the other components.

Motor 40 includes a blower wheel (not shown) therein which draws air into the burner through air entry port 80. The air is forced out of air tube 100, mixing with atomized oil from gun assembly 90, resulting in controlled combustion of the ignited oil extending outwardly from air tube 100.

Figure 2:
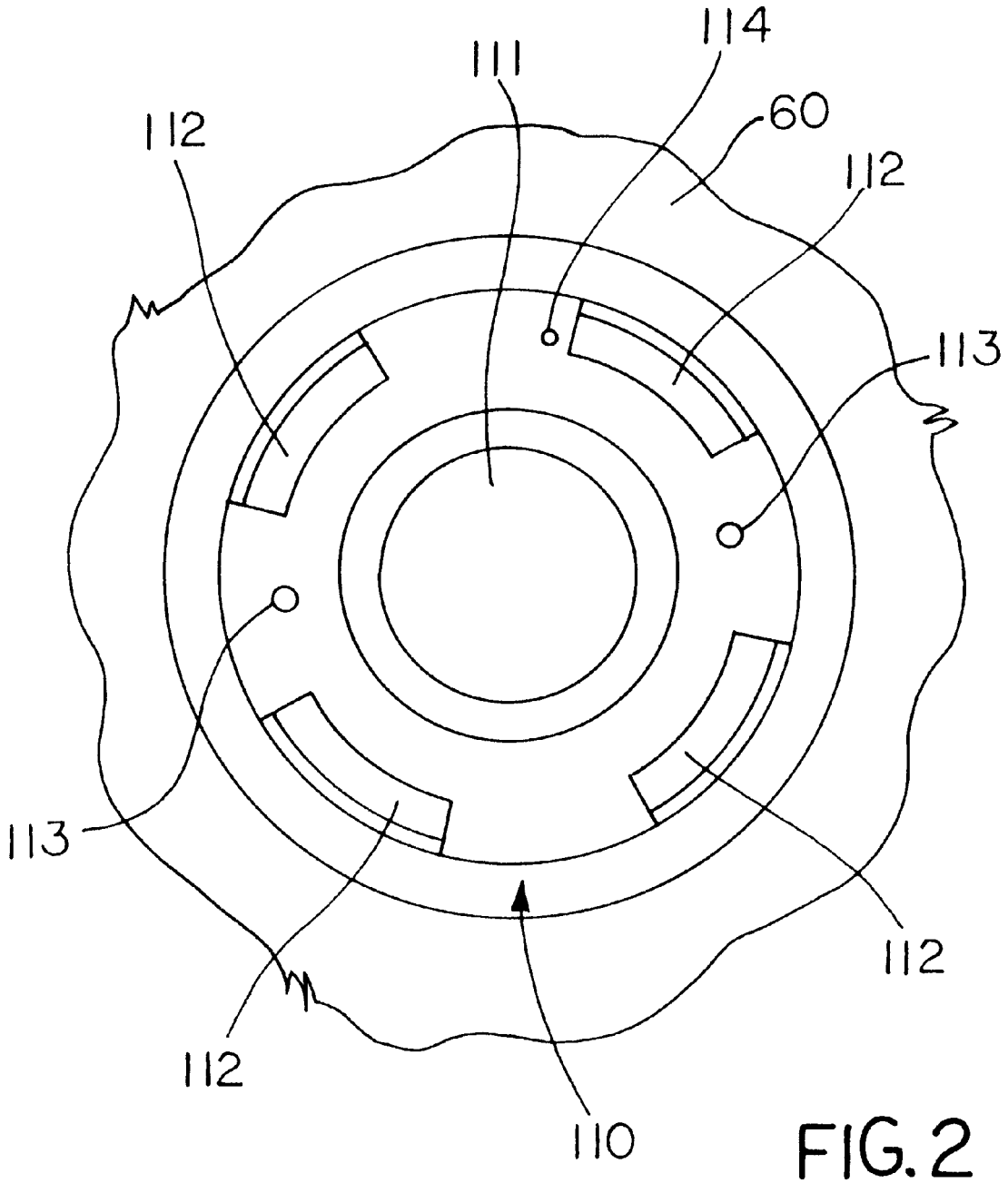
FIG. 2 is a front plan view of a portion of an air inlet that is a component of the oil burner shown in FIG. 1.

Air entry port 80 includes a cover 81 disposed over a cylindrical projection 110 extending from housing 60. A front plan view of projection 110 is shown in FIG. 2. Projection 110 includes a central opening 111 and a plurality of gaps 112 cut through both the face and sidewalls of projection 110 at the perimeter thereof. A pair of mounting holes 113 are located in the front face of projection 110. A third mounting hole 114 is also located in the front face of projection 110 adjacent one of the gaps 112. Cover 81 is secured to projection 110 by a pin or screw 82 extending through slot 83 in cover 81. Pump 20 is secured to body 60 by screws or similar fasteners extending through slots (not shown) in cover 81. Cover 81 further includes a plurality of baffles 84 extending outwardly at an angle from the central portion of cover 81. Baffles 84 are separated by side wall segments 85 which extend inwardly toward housing 60. Extended portions or spacers 86 extend from cover 81 toward housing 60 beyond baffles 84. In this manner, when cover 81 is in place on projection 110, spacers 86 contact housing 60 and hold baffles 84 in spaced apart relation from housing 60. Spacers 86 transition into cut-away air inlets 87 beneath baffles 84. A pointer 88 extends from one baffle 84 toward housing 60.

When assembled as shown in FIG. 1, cover 81 is placed over projection 110 and screw 82 extends through slot 83 into hole 114. Pump 20 extends through an opening in cover 81 (not shown) that is axially aligned with opening 111 in projection 110. Screws or similar fasteners are used to secure pump 20 to projection 110 through holes 113. A plurality of slots (not shown) are formed in cover 81 and are aligned with holes 113 to allow the screws to extend through cover 81 into holes 113. The screw and slot arrangement used to mount pump 20 provide enough clearance to allow cover 81 to rotate within the range permitted by slot 83. The slots through which the screws securing pump 20 to projection 110 extend are of at least the same length as slot 83 to allow a full range of movement. Pointer 88 is located adjacent a scale 115 on housing 60. The scale may be marked as desired. For example, it may be divided into different points referencing a gallon per hour firing rate. To obtain the proper amount of air for a given combustion rate, cover 81 is rotated such that pointer 88 is adjacent the appropriate marking on scale 115. When cover 81 is rotated to the desired position, screw 82 is tightened to prevent further movement.

Figure 3:
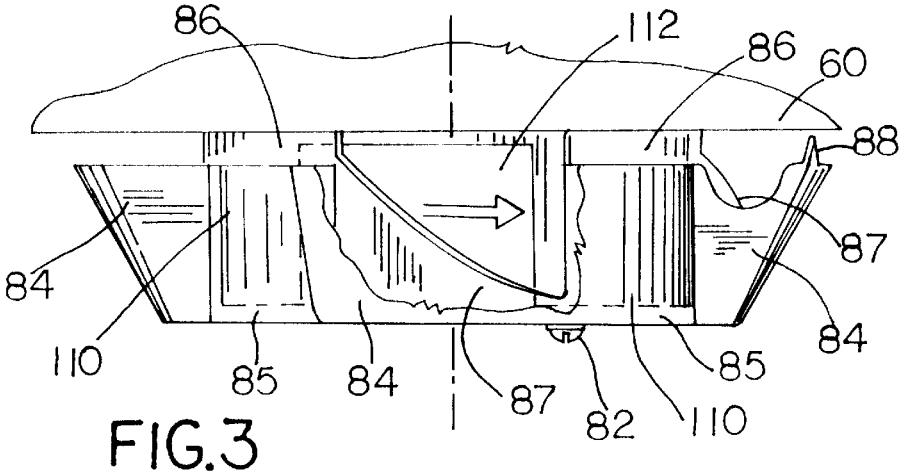
FIG. 3 is a top partial cut-away view of an air inlet that is a component of the oil burner shown in FIG. 1.

As cover 81 is rotated, spacers 86 and cut-away air inlets 87 move with respect to gaps 112. When all or part of cut-away air inlets 87 is disposed adjacent a gap 112, as shown in FIG. 3, air can flow between baffles 84 and housing 60, into gap 112 and into oil burner 10. When all of extended spacers 86 are over gaps 112, they are completely closed off and no air enters gaps 112 between cover 81 and housing 60. Note that in the particular embodiment shown, because slot 83 is positioned between two baffles 84, as are extended spacers 86, it will be located over the portion of gap 112 cut into the face of projection 110 when spacers 86 are over gaps 112. Thus, air can enter burner 10 through slot 83.

Housing cover 70 includes a pair of oppositely disposed arms 71 extending beneath a pair of pins 61 extending from housing 60. At the opposite end of cover 70 on the pump side of housing 60 a pin 62 extends from housing 60 through a slot 72 in cover 70. Slot 72 curves upwardly toward the rear of oil burner 10. On the opposite side of housing 60, a pin or securement screw (not shown) extends through a corresponding slot 72 and into housing 60. In the closed position, pin 62 and the securement screw are disposed at the one end of slots 72. Arms 71 extend beneath pins 61. To raise cover 70 to the position shown in dashed lines, the securement screw is loosened and cover 70 is slid backward such that pin 62 and the securement screw travel to the opposite end of slots 72. In this position, arms 71 are spaced apart from pins 61. Cover 70 may then be pivoted about pin 62 and the securement screw to the upright position. Cover 70 also includes an opening 73 to accommodate gun assembly 90, as described below.

Figure 4A:
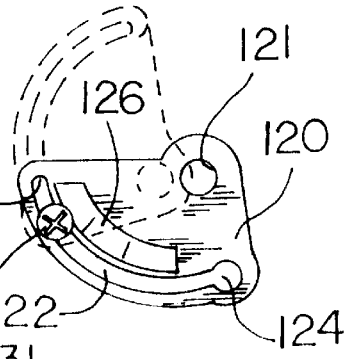
FIG. 4*a* is a top plan view of a cam that is a component of the oil burner shown in FIG. 1.
Figure 4:
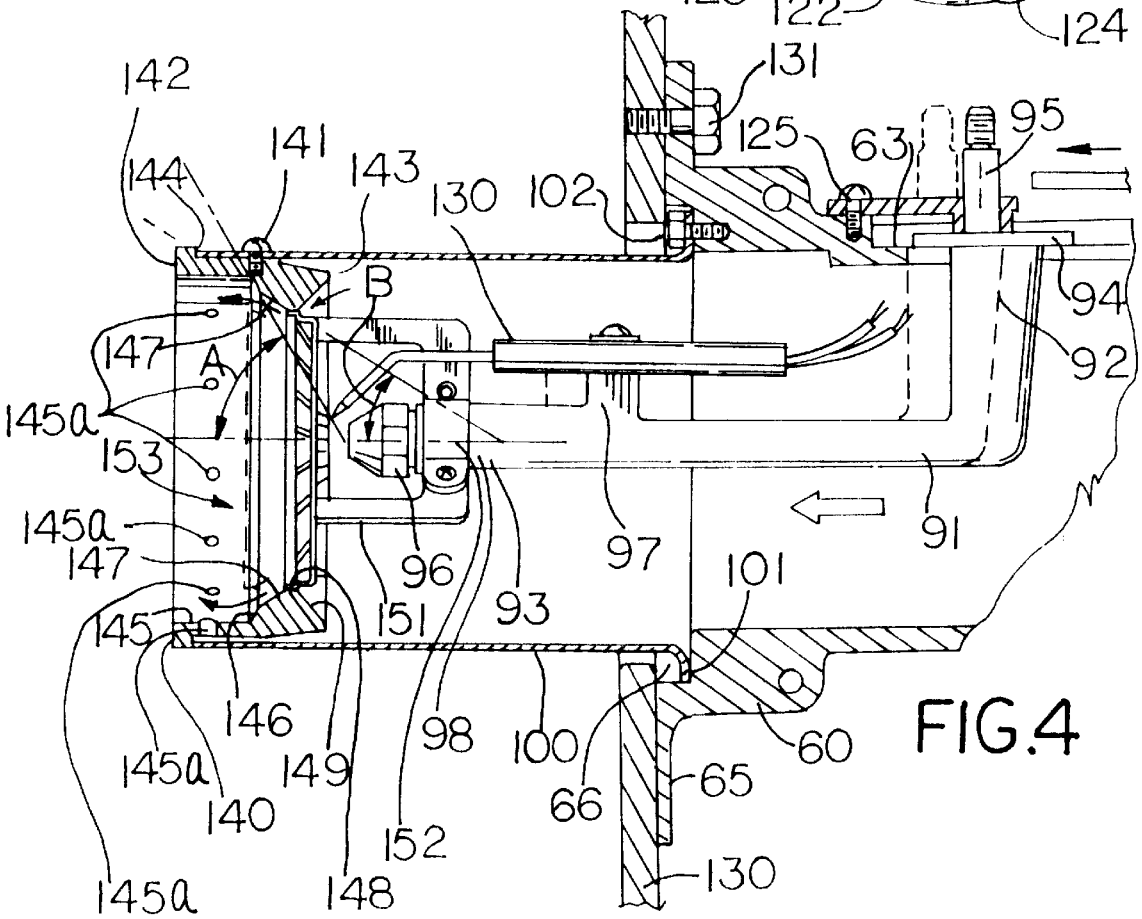
FIG. 4 is partial sectional view taken along line 4—4 in FIG. 1.

Turning to FIGS. 4 and 4*a*, gun assembly 90 includes a unitary body 91 having a first end 92 and a second end 93. First end 92 terminates in a flange 94. Flange 94 receives oil inlet adapter fitting 95 through an opening (not shown). Oil inlet adapter fitting 95 is attached to oil line 22 as shown in FIG. 1. The opening in flange 94 and the outer surface of oil inlet adapter fitting 95 may be correspondingly threaded to secure oil inlet adapter fitting 95 to body 91. Second end 93 is also provided with an opening (not shown) for receiving a nozzle 96. Again, nozzle 96 and the opening in second end 93 may be correspondingly threaded for attachment. The opening in first end 92 and second end 93 are in fluid communication through a cavity in body 91. An electrode mounting platform 97 is also integrally formed with body 91 for mounting electrodes 130 thereto.

A cam 120 includes a hole 121 through which oil inlet adapter fitting 95 is inserted such that cam 120 may be rotated about oil inlet adapter fitting 95. A lock ring 99 (FIG. 5) may be attached to oil inlet adapter fitting 95 to prevent cam 120 from inadvertently being removed from gun assembly 90. Cam 120 further includes a slot 122 having a first end 123 and a second enlarged end 124. A pin or screw 125 extends through slot 122 and into housing 60 of oil burner 10. Enlarged end 124 of slot 122 is larger than the head of screw 125 so that cam 120 may be lifted over screw 125 without completely removing screw 125 from housing 60. By locking cam 120 onto gun assembly 90 with lock ring 99, and installing cam 120 over screw 125 through enlarged end 124 of slot 122, the gun assembly 90 is properly self-located within burner 10.

When in positions, flange 94 is supported and located by a recessed surface 63 of housing 60 as shown. Cam 120 is located above cover 70. As noted above, cover 70 is provided with an opening 73 to accommodate gun assembly 90. In particular, opening 73 provides clearance for oil inlet adapter fitting 95 and cam 120 so the gun assembly 90 may move along the longitudinal axis of air tube 100.

To move gun assembly 90, screw 125 is loosened and cam 120 is rotated. As cam 120 is rotated, slot 122 rides along screw 125, which is fixed. In the embodiment shown, hole 121 in cam 120 is closer to second end 124 of slot 122 than it is to first end 123. Thus, hole 121 moves closer to screw 125 as cam 120 is rotated in a clockwise direction. As this occurs, hole 121 bears against oil inlet adapter fitting 95 thereby pulling gun assembly 90 with it. This causes gun assembly 90 to move forward. Rotating cam 120 in the opposite direction causes gun assembly 90 to move backward. Movement is shown by the dashed lines in FIGS. 4 and 4*a*. Cam 120 may also be provided with a scale 126 having reference markings for various firing rates. When screw 125 is adjacent the appropriate position on scale 126, it is tightened to secure gun assembly 90 in the desired location.

Figure 5:
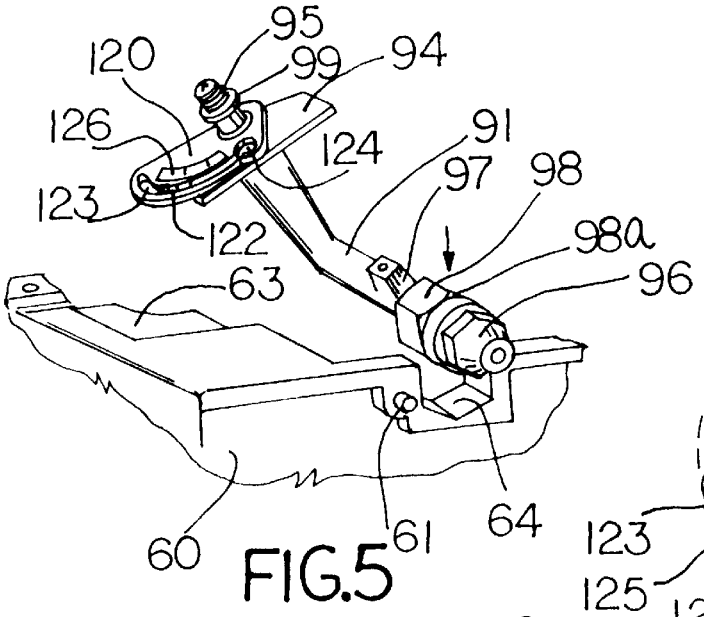
FIG. 5 is a partial view of the housing of the oil burner shown in FIG. 1 illustrating a work station located therein.

Turning briefly to FIG. 5, housing 60 is provided with a work station 64 for mating with a corresponding surface 98 of body 92 to facilitate replacement of nozzle 96. In particular, placing surface 98 in work station 64 prevents body 92 from rotating when a wrench or other tool is applied to nozzle 96.

Returning to FIGS. 1 and 4, air tube 100 is a generally cylindrical member terminating in a flange 101. Flange 101 abuts flange 65 of housing 60. Housing 60 is formed in two halves and half of flange 65 is integrally formed with each half of housing 60. Flange 65 includes a recessed surface 66 in which flange 101 of air tube 100 rests. Air tube 100 may be attached to flange 65 by screws or similar fasteners 102 as shown. Flange 65 is angled slightly with respect to the axis of air tube 100. In the embodiment shown, flange 65 is tilted backward slightly at the top and forward slightly at the bottom. FIG. 4 shows flange 65 abutting the wall of a combustion chamber 130. Oil burner 10 is secured to combustion chamber 130 with screws or similar fasteners 131 extending through holes 67 in flange 65. Holes 67 are keyed to allow flange 65 to be placed over fasteners 131 and rotated into position.

Air cone 140 is located in air tube 100 and fastened thereto with screws 141 or similar fasteners. Air cone 140 has a first end 142 and a second end 143. Air cone 140 further includes a lip 144 which abuts air tube 100 to properly locate air cone 140. The interior region of air cone 140 is divided into several surfaces. Beginning at first end 142, a cylindrical surface 145 extends back toward second end 143 and is coaxial with air tube 100. Surface 145 has a plurality of circular openings 145*a*. Openings 145*a* are in fluid communication with the interior of air tube 100. Surface 146 angles inwardly toward the central axis of air cone 140. The angle A between surface 146 and the central axis is approximately 45°. Surface 147 also angles inwardly toward the central axis of air cone 140. The angle B between surface 147 and the axis is approximately 20°. Surface 148 (also known as the "burner orifice", is also a cylindrical surface that is coaxial with air tube 100. Surface 149 extends away from the central axis of air cone 140 with distance from first end 142.

Figure 6:
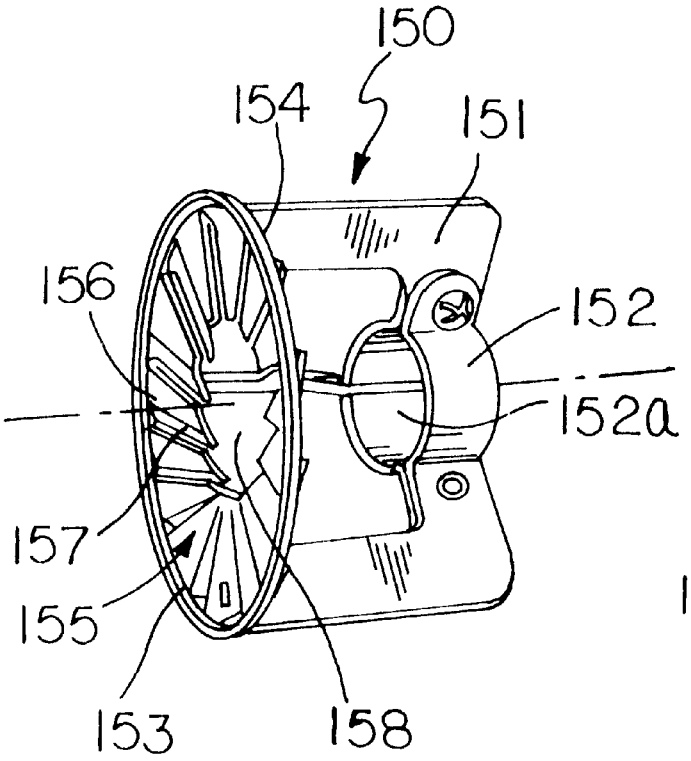
FIG. 6 is a perspective view of a spinner that is a component of the oil burner shown in FIG. 1.
Figure 7:
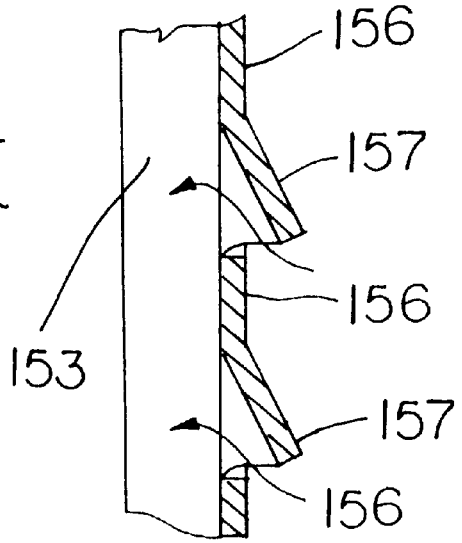
FIG. 7 is a cross-sectional view of two of the blades of the spinner shown in FIG. 6.

A spinner assembly 150 (FIGS. 4, 6 and 7) is secured to second end 93 of body 91 of gun assembly 90. Spinner assembly 150 includes a plurality of legs 151 joined to form a ring 152 having a central opening 152*a* for receiving a portion of body 91 to locate and attach spinner assembly 150 to gun assembly 90. In particular, nozzle 96 is inserted through central opening 152*a* until ring 152 abuts surface 98*a*, which is adjacent surface 98 and perpendicular thereto. At the opposite end of legs 151, spinner 150 includes a rim 153. Rim 153 is angled inward and terminates in a substantially flat rear face 154. A plurality of blades 155 are angled inward from rim 153. Blades 155 are configured so as to have a substantially flat surface 156 and an angled surface 157. Flat surfaces 156 of each blade 155 lay in the same plane. Approximately 22% of each blade 155 comprises flat surface 156. Angled surface 157 is angled inwardly to maintain a constant gap of approximately 0.040 inches between the top of one blade 155 and the bottom of the adjacent blade 155. Blades 155 are joined to rim 153 along the peripheral edge of flat surfaces 156. Blades 155 are not joined in the center of spinner 150, but rather terminate at an opening 158. Opening 158 has a diameter of approximately 0.88 inch. Spinner 150 has an outside diameter of approximately 2.52 inches.

Air cone 140 and spinner 150 are designed to provide four regions of air flow. Opening 152*a* in the center of blades 155 of spinner 150 allows a cylinder of air to surround the atomized oil flowing out of nozzle 96. Air flow through the gaps between spinner blades 155 provides the primary mixing of the combustion air and atomized fuel flow. The rotating air flow provides turbulence and secondary recirculation in the flame zone. The blade configuration minimizes low pressure zones on the surface of the spinner resulting in cleaner combustion. The cylindrical gap between the outside of rim 153 on spinner 150 and air cone 140 helps shape the flame by pushing the flame out of the burner and keeping the flame and unburnt fuel off of air cone 140. Air flow from holes 145*a* in surface 145 of air cone 140 is known as tertiary air flow. The air flow through holes 145*a* provides for a fine tuning of the flame by eliminating low pressure zones that may form at the intersection of surfaces 145 and 146.

In operation, the combustion rate is determined by selecting the desired nozzle 96 and adjusting the position of gun assembly 90 (with spinner 150) and cover 81 accordingly. The nozzle is selected to permit the proper quantity of oil into burner 10 during firing. Cover 81 of air entry port 80 is rotated such that pointer 88 is adjacent the desired marking on scale 115. Pin or screw 82 is then tightened to lock cover 81 in place. This allows the proper quantity of air to enter the burner with sufficient pressure for proper combustion. Cam 120 is then rotated until the marking on scale 126 corresponding to the marking on scale 115 is adjacent screw 125. This causes gun assembly 90 and spinner 150 to move along the axis of the air tube 100, thereby positioning the spinner relative to the air cone 140. When the proper position is reached, screw 125 is tightened to lock gun assembly 90 and spinner 150 in place. Note that when gun assembly 90 is in its rearward position, rim 153 of spinner 150 is adjacent surface 148 of air cone 140. As gun assembly 90 is moved forward, rim 153 of spinner 150 moves adjacent surface 147 and then adjacent surface 146. Because these surfaces angle outward away from the central axis of air tube 100 with distance from second end 143 of air cone 140, more air can flow through the plane in which spinner assembly 150 lies, thereby allowing a larger flow of combustion air to flow between air cone 140 and rim 153 of spinner 150. Surface 146 and round openings 145*a* perform the additional function of preventing or reducing a low pressure area within air cone 140. This prevents build-up of carbon from unburned oil. Note also that air cone 140 may be removed from air tube 100 by removing screws 141. This makes it possible to change from one air cone 140 to another. Likewise, air tube 100 may be removed from housing 60 and replaced.

Although the present invention has been shown and described in detail, it is to be clearly understood that the same is by way of illustration and example only and is not to be taken by way of limitation. Numerous changes can be made to the above embodiments without departing from the scope of the invention. For example, the components are not limited to their specific configurations. Accordingly, the scope of the present invention is limited only by the claims appended hereto.

What is claimed is:

1. An oil burner, comprising:

a housing;

a gun assembly disposed within said housing, said gun assembly having a longitudinal axis;

a cam coupled to said gun assembly and said housing; and movement of said cam causing movement of said gun assembly relative to said housing along said longitudinal axis.

2. The oil burner according to claim 1, wherein said cam is rotatably coupled to said gun assembly.

3. The oil burner according to claim 2, wherein said cam includes a slot and a pin extending through said slot into said housing.

4. The oil burner according to claim 3, wherein said pin includes an enlarged portion to prevent vertical displacement of said pin from said slot.

5. The oil burner according to claim 4, wherein said slot includes an enlarged portion to allow said cam to be lifted over said enlarged portion of said pin.

6. The oil burner according to claim 3, wherein said pin may be adjusted to lock said cam in a desired position.

7. The oil burner according to claim 1, further comprising a flange coupled to said gun assembly and contacting a portion of said housing.

8. The oil burner according to claim 1, wherein said gun assembly includes an inlet adapter fitting and said cam rotates about said fitting.

9. The oil burner according to claim 1, further comprising at least one reference marking for locating said cam in a desired position.

10. The oil burner according to claim 1, wherein movement of said cam causes movement of said gun assembly.

11. A gun assembly for an oil burner, comprising:

a body having an oil inlet and a passageway therethrough;

a nozzle attachment portion; and wherein said body and said nozzle attachment portion are integrally formed.

12. The gun assembly according to claim 11, further comprising an integrally formed electrode mounting platform.

13. The gun assembly according to claim 11, further comprising an integrally formed flange.

14. The gun assembly according to claim 13, wherein said flange is disposed so as to locate said gun assembly in said oil burner.

15. The gun assembly according to claim 11, wherein said body includes a surface configured to mate with a tool.

16. The gun assembly according to claim 11, further comprising a spinner assembly and a surface on said gun assembly for locating said spinner assembly thereon.

17. An oil burner, comprising;

a housing;

a gun assembly including a removable nozzle; and a work station in said housing, said work station generally conforming to the shape of a portion of said gun assembly for facilitating removal of said nozzle.

18. An oil burner, comprising;

a housing;

a first pin extending from said housing;

a second pin extending from said housing;

a cover;

a slot in said cover disposed about said first pin, said slot having a first end and a second end; and an arm extending from said cover beneath said second pin, said slot, arm and pins arranged such that said arm prevents said cover from pivoting when said first pin is at or near said first end of said slot but allows said cover to pivot when said first pin is at or near said second end of said slot.

19. The oil burner according to claim 18, further comprising means for locking said cover in place.

20. The oil burner according to claim 19, wherein said means for locking said cover in place includes a screw.

21. The oil burner according to claim 19, wherein said means for locking said cover extends through a second slot in said cover.

22. An oil burner, comprising:

an air cone having a first end, a second end and an axis extending from said first end to said second end;

a first surface of said air cone angling inward toward said axis with distance from said first end; and a second surface of said air cone angling inward toward said axis with distance from said first end, the angle between said axis and said second surface being less that the angle between said axis and said first surface.

23. The oil burner according to claim 22, wherein said first surface of said air cone is adjacent said second surface.

24. The oil burner according to claim 22, wherein said air cone further includes a third surface angling away from said axis with distance from said first end.

25. The oil burner according to claim 24, wherein said air cone further includes a fourth surface parallel with said axis.

26. The oil burner according to claim 25, wherein said air cone further includes a fifth surface parallel with said axis.

27. The oil burner according to claim 22, wherein said air cone further includes a third surface parallel with said axis.

28. The oil burner according to claim 27, wherein said third surface is disposed between said first end and said first surface.

29. The oil burner according to claim 27, wherein said third surface is disposed between said first surface and said second end.

30. The oil burner according to claim 27, further comprising a gun assembly having a spinner movable between positions adjacent said first, second and third surfaces.

31. The oil burner according to claim 27, further comprising at least one hole in said third surface.

32. The oil burner according to claim 31, wherein said hole extends completely through a portion of said air cone.

33. The oil burner according to claim 22, further comprising a gun assembly having a spinner disposed within said air cone.

34. The oil burner according to claim 33, wherein said spinner is movable between positions adjacent said first and second surfaces.

35. An oil burner having a housing and an air entry port, said port comprising:

a projection extending from said housing;

at least one gap formed in said projection; and a cover having an extended portion extending toward said housing, said cover disposed adjacent said projection and moveable with respect thereto such that said extended portion can be positioned to cover a portion of said gap.

36. The oil burner according to claim 25, further comprising a pin extending from said projection through an opening in said cover.

37. The oil burner according to claim 36, wherein said opening is disposed over a portion of said gap when said extended portion is disposed so as to cover a portion of said gap.

38. The oil burner according to claim 25, further comprising means for locking said cover in place.

39. The oil burner according to claim 38, wherein said means for locking said cover in place includes a screw.

40. The oil burner according to claim 25, further comprising at least one baffle extending outward from said cover.

41. The oil burner according to claim 40, wherein said baffle is disposed so as to partially overlap said extended portion.

42. The oil burner according to claim 25, further comprising an opening in said cover, an opening in said projection and a pump extending through said openings into said housing.

43. An oil burner spinners comprising:

a rim having a front face and a substantially flat rear face;

a plurality of blades attached to said rim and having a first surface and a second surface;

said first surface of each of said blades disposed in substantially the same plane; and said second surface of said blades angled so as to extend behind said rear face of said rim.

44. The spinner according to claim 43, further comprising a leg assembly attached to said rim.

45. The spinner according to claim 43, wherein said rim is angled inward.

46. The spinner according to claim 43, further including an opening through the center of said spinner.

47. The spinner according to claim 43, wherein the substantially constant gap is maintained between said blades.

48. The spinner according to claim 43, further comprising a plurality of legs extending from said rim.

49. The spinner according to claim 48, wherein said legs locate said spinner on a gun assembly.

* * * * *